US010472109B2

(12) United States Patent
Catellani et al.

(10) Patent No.: US 10,472,109 B2
(45) Date of Patent: Nov. 12, 2019

(54) FOLDING UNIT FOR PRODUCING PACKAGES FROM SEALED PACKS AND METHOD FOR PRODUCING PACKAGES FORM SEALED PACKS

(71) Applicant: Tetra Laval Holdings & Finance S.A., Pully (CH)

(72) Inventors: Andrea Catellani, Modena (IT); Herbert Bartolini, Modena (IT); Luisa D'Amato, Modena (IT); Lucia Izzo, Modena (IT); Franco Santi, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 16/084,342

(22) PCT Filed: Mar. 3, 2017

(86) PCT No.: PCT/EP2017/055088
§ 371 (c)(1),
(2) Date: Sep. 12, 2018

(87) PCT Pub. No.: WO2017/157700
PCT Pub. Date: Sep. 21, 2017

(65) Prior Publication Data

US 2019/0077532 A1 Mar. 14, 2019

(30) Foreign Application Priority Data

Mar. 17, 2016 (EP) ..... 16160798

(51) Int. Cl.
*B65B 49/14* (2006.01)
*B65B 55/10* (2006.01)
(Continued)

(52) U.S. Cl.
CPC ..... *B65B 49/14* (2013.01); *B65B 55/103* (2013.01); *B65B 59/00* (2013.01); *B65B 59/04* (2013.01); *B65B 61/24* (2013.01); *B65B 3/02* (2013.01)

(58) Field of Classification Search
CPC ..... B65B 3/02; B65B 49/14; B65B 55/103; B65B 59/00; B65B 59/04; B65B 61/28;
(Continued)

(56) References Cited

U.S. PATENT DOCUMENTS 2,682,330 A * 6/1954 Thomas ..... B65G 17/12 198/403
3,975,888 A * 8/1976 Jones ..... B65B 3/02 53/386.1

(Continued)

FOREIGN PATENT DOCUMENTS

EP 0 819 609 1/1998
EP 0 887 261 12/1998

(Continued)

OTHER PUBLICATIONS

International Search Report corresponding PCT Application No. PCT/EP2017/055088 dated Apr. 11, 2017 (6 pages).

*Primary Examiner* — Andrew M Tecco
*Assistant Examiner* — Nicholas E Igbokwe
(74) *Attorney, Agent, or Firm* — Finnegan, Henderson, Farabow, Garrett & Dunner, L.L.P.

(57) ABSTRACT

A folding unit for producing packages from sealed packs comprises an endless conveyor carrying a plurality of paddles arranged for moving said packs along an advancement direction and fold said packs into formed packages, each paddle having a first surface intended to interact with a first pack to form a portion of a corresponding first package and a second surface intended to interact with a second pack to form a portion of a corresponding second package, said (Continued)

folding unit further comprises releasable connecting elements arranged for releasably connecting said paddles to said endless conveyor.

16 Claims, 7 Drawing Sheets

(51) Int. Cl.

| | |
|---|---|
| ***B65B 61/24*** | (2006.01) |
| ***B65B 59/04*** | (2006.01) |
| ***B65B 59/00*** | (2006.01) |
| *B65B 3/02* | (2006.01) |

(58) Field of Classification Search
CPC ..... B65B 35/24; B65G 17/323; B65G 17/46; B65G 2201/0235; B65G 2201/025; B31B 3/00
USPC ..... 493/162
See application file for complete search history.

(56) References Cited

U.S. PATENT DOCUMENTS 5,966,899 A * 10/1999 Fontanazzi ..... B65B 7/20 53/374.7
2008/0283361 A1* 11/2008 Martini ..... B65B 21/242 198/460.2
2014/0194267 A1* 7/2014 Pradelli ..... B65B 49/04 493/243
2014/0196417 A1* 7/2014 Galata' ..... B65B 61/24 53/551
2014/0223858 A1* 8/2014 Pedretti ..... B65B 35/58 53/203
2014/0283489 A1* 9/2014 Zhu ..... B65G 17/32 53/491
2014/0371046 A1* 12/2014 Catellani ..... B65B 51/20 493/162

FOREIGN PATENT DOCUMENTS

| | | | | |
|---|---|---|---|---|
| EP | 1 101 700 | | 5/2001 | |
| EP | 1 145 961 | | 10/2001 | |
| EP | 1 726 526 | | 11/2006 | |
| EP | 2 586 718 | | 5/2013 | |
| EP | 2 631 188 | | 8/2013 | |
| EP | 2 746 170 | | 6/2014 | |
| EP | 2746170 | A1 * | 6/2014 | ..... B65B 61/24 |
| EP | 2 789 546 | | 10/2014 | |
| EP | 2 886 473 | | 6/2015 | |
| JP | S63 55038 | | 3/1988 | |
| WO | WO 2007-033113 | | 3/2007 | |

* cited by examiner

FOLDING UNIT FOR PRODUCING PACKAGES FROM SEALED PACKS AND METHOD FOR PRODUCING PACKAGES FORM SEALED PACKS

CROSS-REFERENCE TO RELATED PATENT APPLICATIONS

This is a National Phase of International Application No. PCT/EP2017/055088, filed Mar. 3, 2017, which claims the benefit of European Application No. 16160798.1 filed Mar. 17, 2016. The entire contents of the above-referenced applications are expressly incorporated herein by reference.

TECHNICAL FIELD

The present invention relates to a folding unit for producing packages from sealed packs, in particular for producing packages of food products pourable into a tube of packaging material.

The present invention further relates to a method for producing packages from sealed packs, in particular for producing packages of food products pourable into a tube of packaging material.

BACKGROUND OF INVENTION

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated sheet packaging material.

The packaging material has a multilayer structure substantially comprising a base layer for stiffness and strength, which may comprise a layer of fibrous material, e.g. paper, or of mineral-filled polypropylene material, and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material. The web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating. The web of packaging material so sterilized is maintained in a closed, sterile environment, and is folded and sealed longitudinally to form a vertical tube.

The packaging machines comprise a forming unit, in which the tube is filled continuously downwards with the sterilized or sterile-processed food product, and is sealed and then cut along equally spaced cross sections to form pillow packs, which are then fed to a folding unit to form the finished, e.g. substantially parallelepiped-shaped packages.

More specifically, the pillow packs substantially comprise a parallelepiped-shaped main portion, and a top end portion and a bottom end portion, opposite to each other and projecting laterally on opposite sides of the main portion and defining respective triangular flaps to be folded onto the main portion.

A longitudinal sealing strip, formed when sealing the packaging material to form the vertical tube, extends along the pillow packs. Moreover, the top end portion and bottom end portion of each pillow pack have respective transverse sealing strips perpendicular to the longitudinal sealing strip and defining respective end flaps projecting from the top and bottom of the pack.

The top end portion and the bottom end portion of each pillow pack taper towards the main portion from the respective end flaps, and are pressed towards each other by a folding unit of the packaging machine to form flat opposite end walls of the pack, while at the same time folding the end flaps onto respective walls of the main portion.

Folding units are known, for example from EP-1726526, substantially comprising a chain conveyor for feeding packs continuously along a predominantly straight horizontal forming path from a supply station to an output station, and a plurality of folding devices which cooperate cyclically with each pack along the forming path to flatten the respective top end portion and bottom and portion of the pack and so fold the respective end flaps onto the top end portion and bottom end portion.

The folding unit comprises heating means arranged for heating the packs and melting the plastic material forming the outer plastic layer of the packs at the top end portion and bottom end portion.

In operation, there might be the need to pass from the production of a first type of packages to the production of a second type of packages, the packages of the second type of packages having substantially the same volume as the packages of the first type of packages, but a shape different from the shape of the packages of the first type of packages. In one case, the packages of the first type of packages may have a parallelepiped shape and the packages of the second type of packages may have non-rectangular side walls, for example side walls having curved, or polygonal, panels defining so-called design elements.

In order to switch from the production of the first type of packages to the production of the second type of packages, the folding unit has to be replaced with another forming unit.

The replacement of the folding unit with another folding unit requires a lot of time and a long stop of the packaging machine, which has a significantly high impact on the productivity of the packaging machine.

DISCLOSURE OF INVENTION

An object of the invention is to improve the folding units for forming packages from sealed packs.

Another object of the invention is to improve the methods for forming packages from sealed packs.

Another object of the invention is to obtain a folding unit for folding packs and a method for folding packs that improve the flexibility of the known packaging machines and allow reducing the time and effort needed to switch from the production of a first type of packages to the production of a second type of packages, the packages of the second type of packages being different from the packages of the first type of packages.

According to a first aspect of the present invention, there is provided a folding unit for producing packages from sealed packs, as claimed in claim 1.

According to a second aspect of the present invention, there is provided a method for producing packages from sealed packs, as claimed in claim 13.

BRIEF DESCRIPTION OF THE DRAWINGS

One preferred, non-limiting embodiment of the invention will be described by way of example with reference to the accompanying drawings, in which.

DETAILED DESCRIPTION OF PREFERRED EMBODIMENTS

With reference to FIGS. 1 to 7 there is disclosed a folding unit 1 for a packaging machine (not shown) for continuously producing sealed packages 2 of a pourable food product, such as pasteurized or UHT milk, fruit juice, wine, etc., from a known tube of packaging material (not shown).

The tube is formed in known manner upstream from the folding unit 1 by longitudinally folding and sealing a known web (not shown) of heat-seal sheet material which may comprise a base layer for stiffness and strength, which may be formed by a layer of fibrous material, e.g. paper, or of mineral-filled polypropylene material, and a number of layers of heat-seal plastic material, e.g. polyethylene film, covering both sides of the base layer. In the case of an aseptic package 2 for long-storage products, such as UHT milk, the packaging material may also comprises a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package 2 eventually contacting the food product.

The tube of packaging material is then filled with the food product, and is sealed and cut along equally spaced cross sections to form a number of packs 3, having a pillow-like shape, which are then transferred to the folding unit 1 where they are folded mechanically to form respective packages 2, having a substantially parallelepiped-shape.

Figure 6:
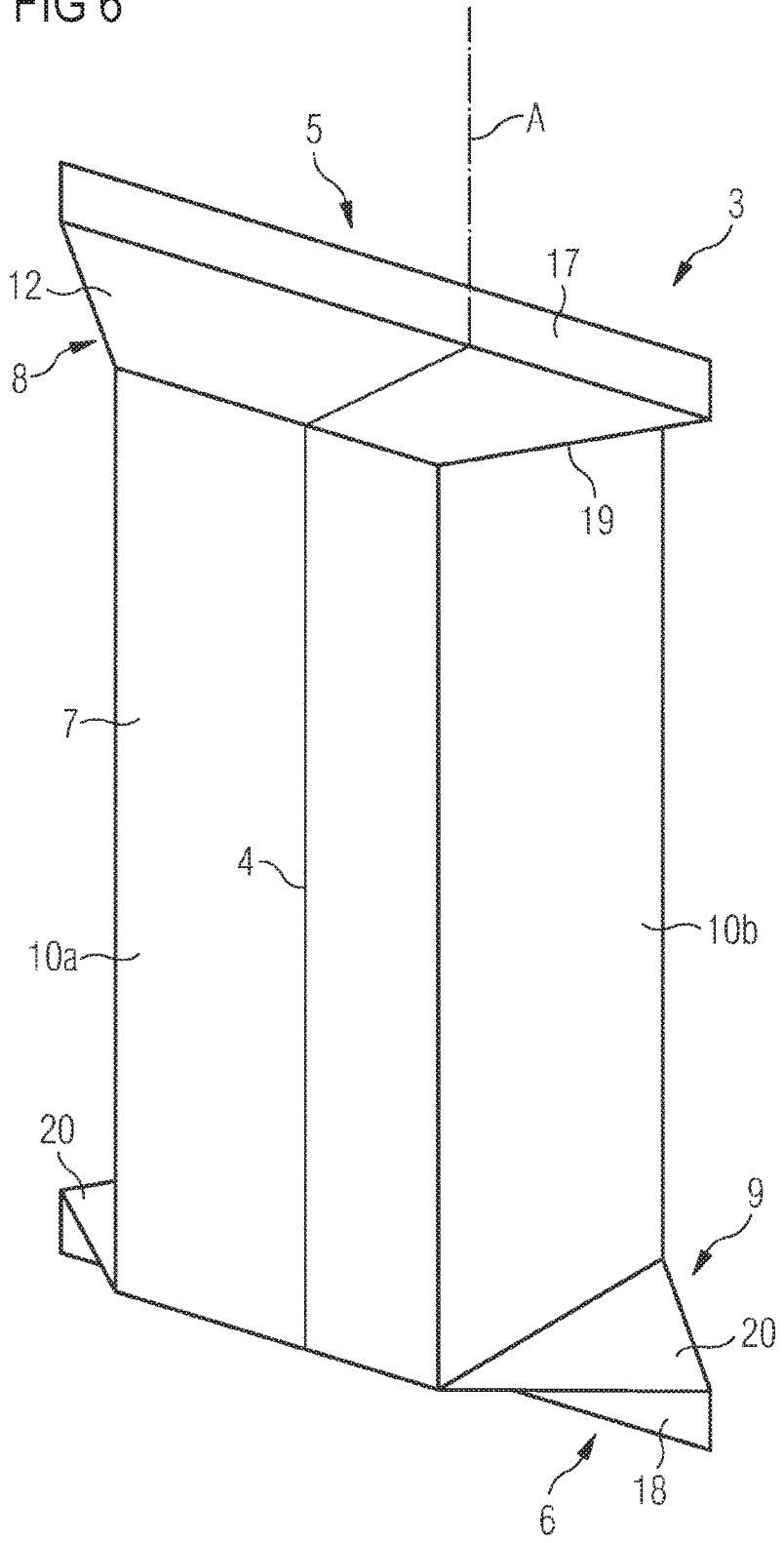
FIG. 6 is a side view in perspective of a pack to be folded with the folding unit of FIG. 1.

With reference to FIG. 6, an embodiment of a pack 3 is shown which has a longitudinal sealing band 4, formed to produce the tube of packaging material from the web folded into a cylinder, and extending along one side of the pack 3, which is closed at opposite ends by a first transversal sealing band 5 and a second transversal sealing band 6 perpendicular to, and joined to, the longitudinal sealing band 4.

The pack 3 has an axis A, and comprises a main body 7, a first end portion 8 and a second end portion 9 tapering from the main body 7 towards the respective first transverse sealing band 5 and second transverse sealing band 6.

The main body 7 of the pack 3 is bounded laterally by two first lateral walls 10*a* and two second lateral walls 10*b* which are alternate to each other.

The first end portion 8 and the second end portion 9 are each defined by two walls 12, each substantially in the form of an isosceles trapezium, which slope slightly towards each other with respect to a plane perpendicular to axis A, and have minor edges defined by opposite edges of the respective first lateral wall 10*a*, and major edges joined to each other by the respective first transversal sealing band 5 and second transversal sealing band 6.

The longitudinal sealing band 4 extends between the first transverse sealing band 5 and the second transverse sealing band 6, and along the whole of one first lateral wall 10*a* and the corresponding walls 12 on the same side as the above-mentioned one first lateral wall 10*a*.

The first end portion 8 comprises a substantially elongated rectangular first end fin 17, formed by the first sealing band 5, and projecting in the direction of axis A from the pack 3. The first end portion 8 further comprises two first triangular flaps 19, projecting laterally on opposite sides of the main body 7, and defined by end portions of the walls 12 and by corresponding triangular end portions of the second lateral walls 10*b*.

Similarly, the second end portion 9 comprises a substantially elongated second rectangular end fin 18, formed by the second sealing band 6, and projecting in the direction of axis A from the pack 3. The second end portion 9 further comprises two second triangular flaps 20, projecting laterally on opposite sides of the main body 7, and defined by end portions of the walls 12 and by corresponding triangular end portions of the second lateral walls 10*b*.

More precisely, each of the first end fin 17 and the second end fin 18 extends along a direction orthogonal to axis A.

To form a package 2, the folding unit 1 presses the first end portion 8 and the second end portion 9 down flat towards each other, and at the same time folds the first end fin 17 onto the flattened first end portions 8 and the second end fin 18 onto the flattened second end portion 9.

Figure 7:
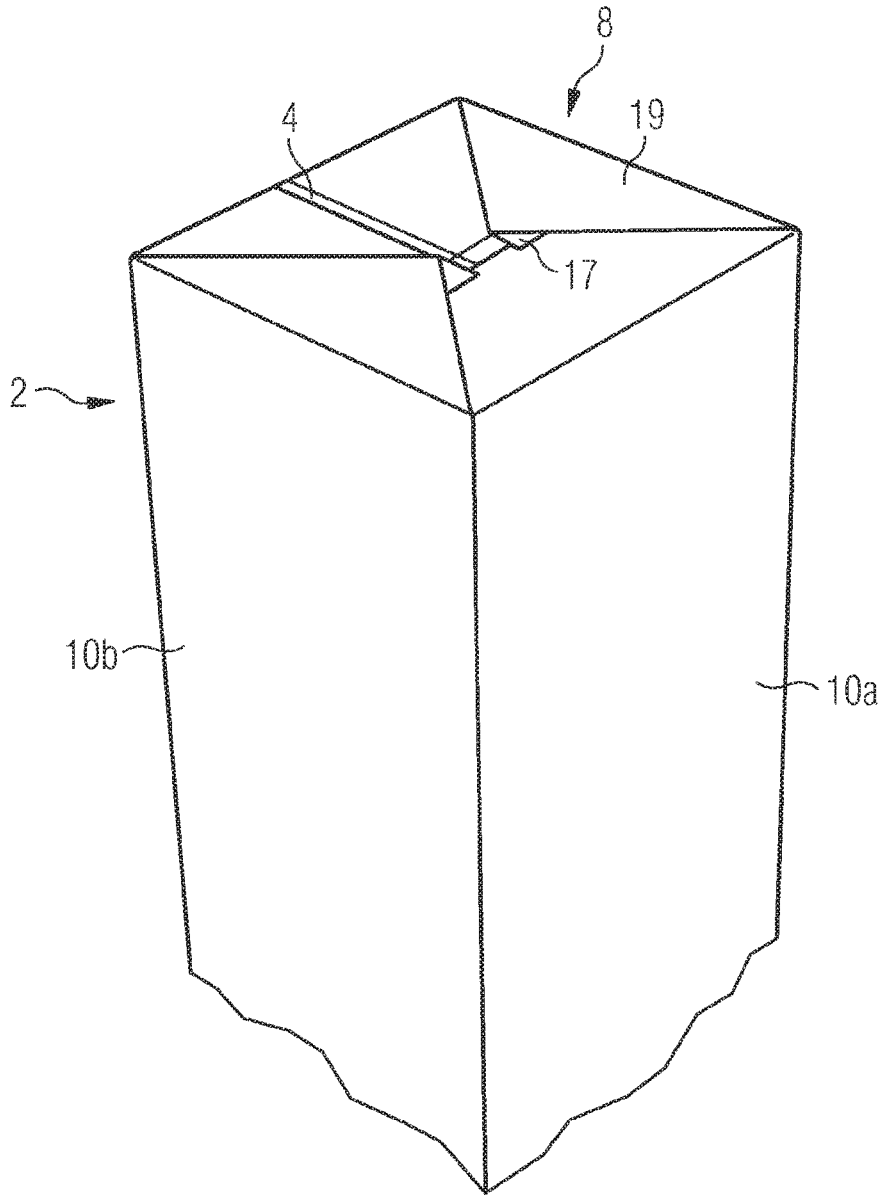
FIG. 7 is a partial side view in perspective of a package obtained by folding the pack of FIG. 6 using the folding unit of FIG. 1.

The folding unit 1 folds the second triangular flaps 20 onto top ends of respective second lateral walls 10*b* towards the first end portion 8 and—as shown in FIG. 7—folds the first triangular flaps 19 onto the previously folded first end fin 17, on the opposite side of the second end portion 9.

With reference to FIGS. 1 to 4, the folding unit 1 comprises an endless conveyor 23 for feeding packs 3 continuously along a forming path B from a supply station 13 to an output station 14.

Figure 1:
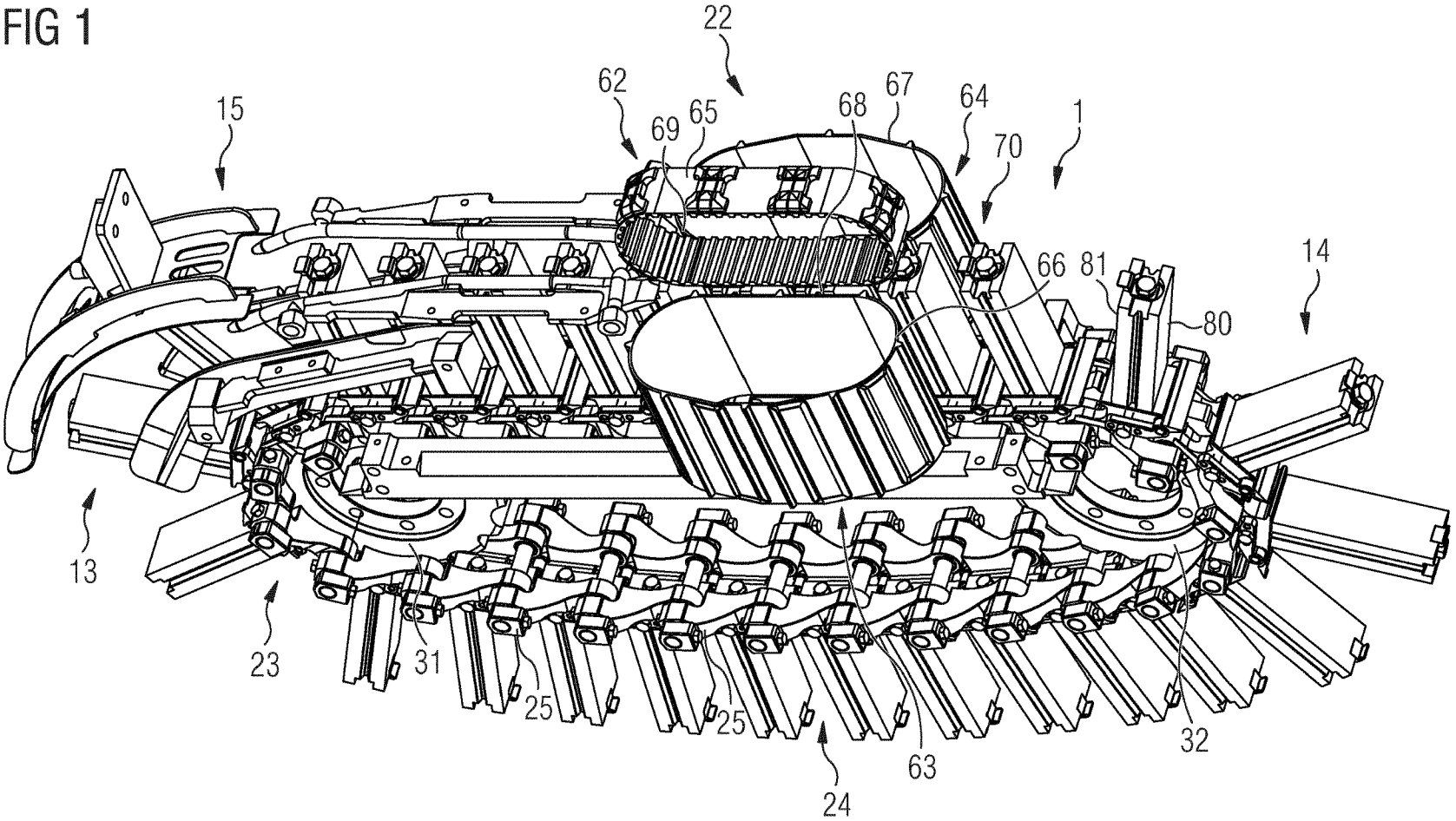
FIG. 1 is a perspective view, with parts removed for clarity, of a folding unit according to the invention.
Figure 2:
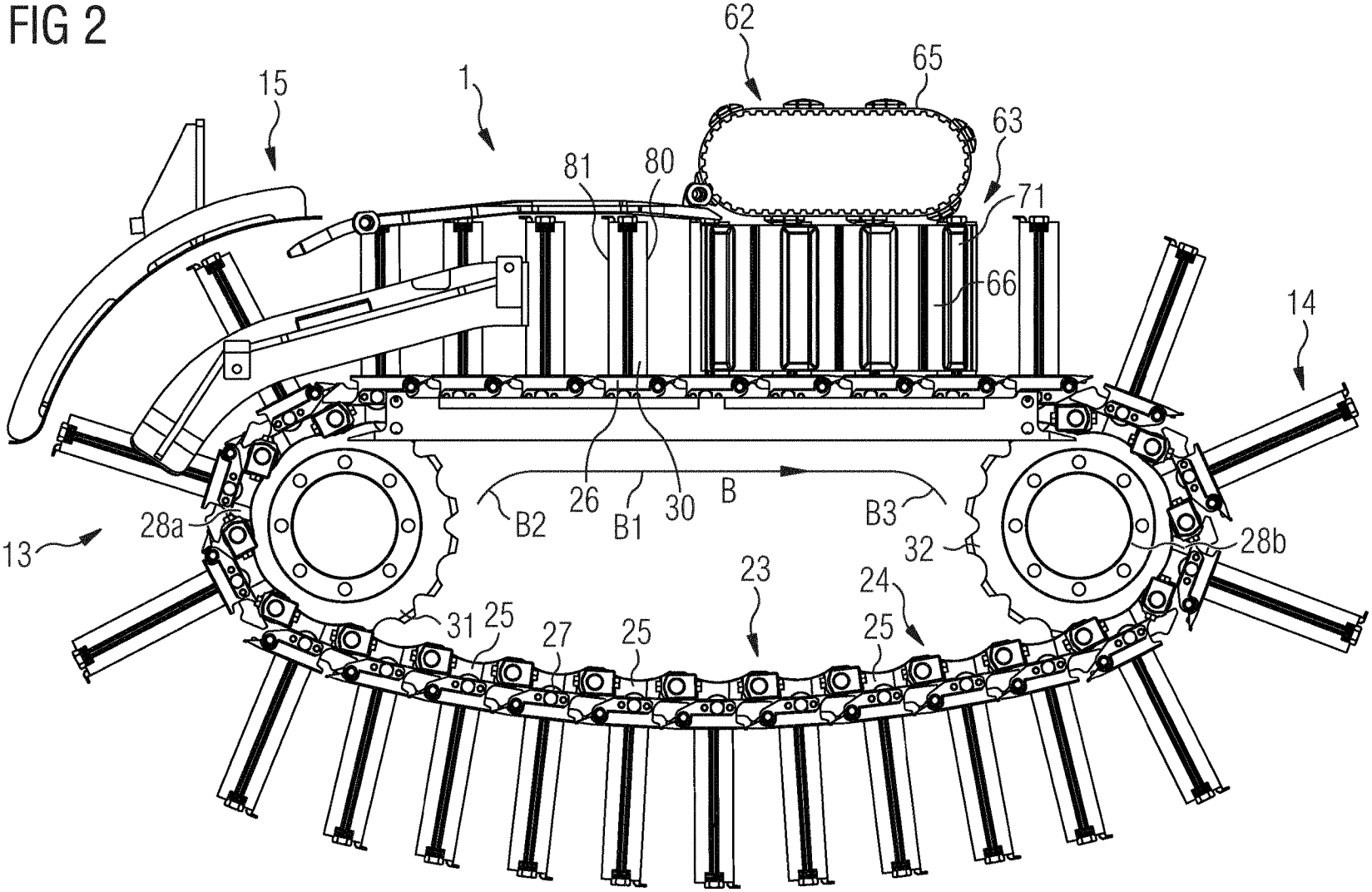
FIG. 2 is a side view, with parts removed for clarity, of the folding unit of FIG. 1.

The folding unit 1 further comprises a first folding arrangement 15, partly shown in FIGS. 1 and 2, which cooperates cyclically with each pack 3 to flatten the first end portion 8 and the second and portion 9, fold the first end fin 17 onto the flattened first end portion 8 and fold second end fin 18 onto the flattened second end portion 9.

The folding unit 1 further comprises a second folding arrangement for folding each of the first triangular flaps 19 onto the previously flattened first end portion 8 on the opposite side of the second end portion 9.

The folding unit 1 further comprises a third folding arrangement for folding each of the second triangular flaps 20 onto the corresponding second lateral wall 10*b* and towards the first end portion 8.

The folding unit 1 also comprises a heating device (not shown) acting on the partially bent, or folded, first triangular flaps 19 and second triangular flaps 20 to melt the external layer of the packaging material of the first triangular flaps 19 and the second triangular flaps 20 before they are pressed and sealed against the first end portion 8 and the second lateral walls 10*b*, respectively.

The folding unit 1 further comprises a pressing device 22 cooperating with each pack 3 to hold the first triangular flaps 19 onto the flattened first end fin 17 as the first triangular flaps 19 cool and to hold the second triangular flaps 20 onto the second lateral walls 10*b* as the second triangular flaps 20 cool.

The heating device is arranged upstream of the pressing device 22 along the forming path B.

The pressing device 22 comprises a top pressing arrangement 62 arranged for pressing the first triangular flaps 19 onto the flattened first end fin 17.

The pressing device 22 further comprises a first lateral pressing arrangement 63 and a second lateral pressing arrangement 64, each of which is arranged for pressing one of the second triangular flaps 20 onto the corresponding second lateral walls 10*b*.

The top pressing arrangement 62 comprises a belt 65 looped around a couple of top pulleys (not shown). The top pulleys have axes arranged in a substantially horizontal plane.

The belt 65 is rotated in the advancement direction of the packs 3 along the forming path B and interacts with the packs 3 whilst the packs 3 are advanced by the endless conveyor 23.

The first lateral pressing arrangement 63 comprises a first belt 66 looped around a couple of first lateral pulleys (not shown). The first lateral pulleys have axes arranged in a substantially vertical plane.

The first belt 66 is rotated in the advancement direction of the packs 3 along the forming path B and interacts with the packs 3 whilst the packs 3 are advanced by the endless conveyor 23.

Similarly, the second lateral pressing arrangement 64 comprises a second belt 67 looped around a couple of second lateral pulleys (not shown). The second lateral pulleys have axes arranged in a substantially vertical plane.

The second belt 67 is rotated in the advancement direction of the packs 3 along the forming path B and interacts with the packs 3 whilst the packs 3 are advanced by the endless conveyor 23.

The first lateral pressing arrangement 63 and the second lateral pressing arrangement 64 are arranged on opposite sides of the endless conveyor 23.

The first belt 66 has a first active branch 68 that interacts with the packs 3.

The second belt 67 has a second active branch 69 that interacts with the packs 3.

The first active branch 68 and the second active branch 69 define a channel 70 through which the packs 3 are advanced by the endless conveyor 23.

The first belt 66 and the second belt 67 have a plurality of bulges 71 extending from an outer surface of the first belt 66 and the second belt 67 and arranged for forming the second lateral walls 10*b*.

The conformation of the bulges 71 is designed so as to give to the second lateral walls 10*b* the desired shape.

The endless conveyor 23 comprises a flexible transport element, in the example shown a chain 24, forming a loop and comprising a plurality of mutually hinged rigid modules or links 25.

Each link 25 comprises a plate 29, adapted to receive a relative pack 3, and a paddle 30 that projects from the plate 29 and cooperates with, and pushes, one of the first lateral walls 10*a* of the pack 3 to feed the pack 3 along the forming path B.

In detail, each paddle 30 has a first surface 80 intended to interact with a first pack 3 to form a portion, in particular a side panel, of a first package 2 and a second surface 81 intended to interact with a second pack 3 to form a portion, in particular a side panel, of a second package 2.

The first surface 80 and the second surface 81 are opposite to each other.

The first surface 80 and the second surface 81 are arranged transversely, particularly perpendicularly, to a straight main portion BI of the forming path B, which will be better described in the following.

The first surface 80 is arranged downstream of the second surface 81 with respect to the advancement direction of the packs 3 along the endless conveyor 23.

The endless conveyor 23 further comprises a drive gear 31 and a driven gear 32.

The chain 24 is looped about, and meshes with, the drive gear 31 and the driven gear 32.

The chain 24 comprises a conveying branch 26, a return branch 27 substantially parallel to the conveying branch 26, a first curved C-shaped portion 28*a* and a second curved C-shaped portion 28*b*, which are positioned with their concavities facing each other and connect the conveying branch 26 and the return branch 27. The middle portions of the first curved C-shaped portion 28*a* and the second curved C-shaped portion 28*b* define the supply station 13 and output station 14, respectively.

The conveying branch 26 is straight and horizontal in the embodiment shown. In particular, the conveying 26 branch is positioned above the return branch 27.

The forming path B comprises the above-mentioned straight main portion $B_1$ defined by the conveying branch 26, a supply curved end portion $B_2$ defined by a top portion of the first C-shaped portion 28*a* and an output curved end portion $B_3$ defined by a top portion of the second C-shaped portion 28*b*. The conveying branch 26, the top portion of the first C-shaped portion 28*a* and the top portion of the second C-shaped portion 28*b*, therefore, define a conveying portion of the chain 24 to convey the packs 3 from the supply station 13 to the output station 14. The return branch 27 and the remaining portions of the first C-shaped portion 28*a* and the second C-shaped portion 28*b* define a return portion of the chain 24 to feed the paddles 30 from the output station 14 to the supply station 13.

Given the structure of the endless conveyor 23, the paddles 30 are positioned vertically along the straight main portion $B_1$ of the forming path B.

Each pack 3 is positioned on the endless conveyor 23 with the second end portion 9 contacting the conveying portion of the chain (i.e. the corresponding plate 29), with one of the first lateral walls 10*a* resting on the corresponding paddle 30, and with the axis A parallel to the paddle 30 and crosswise to the forming path B.

Figure 3:
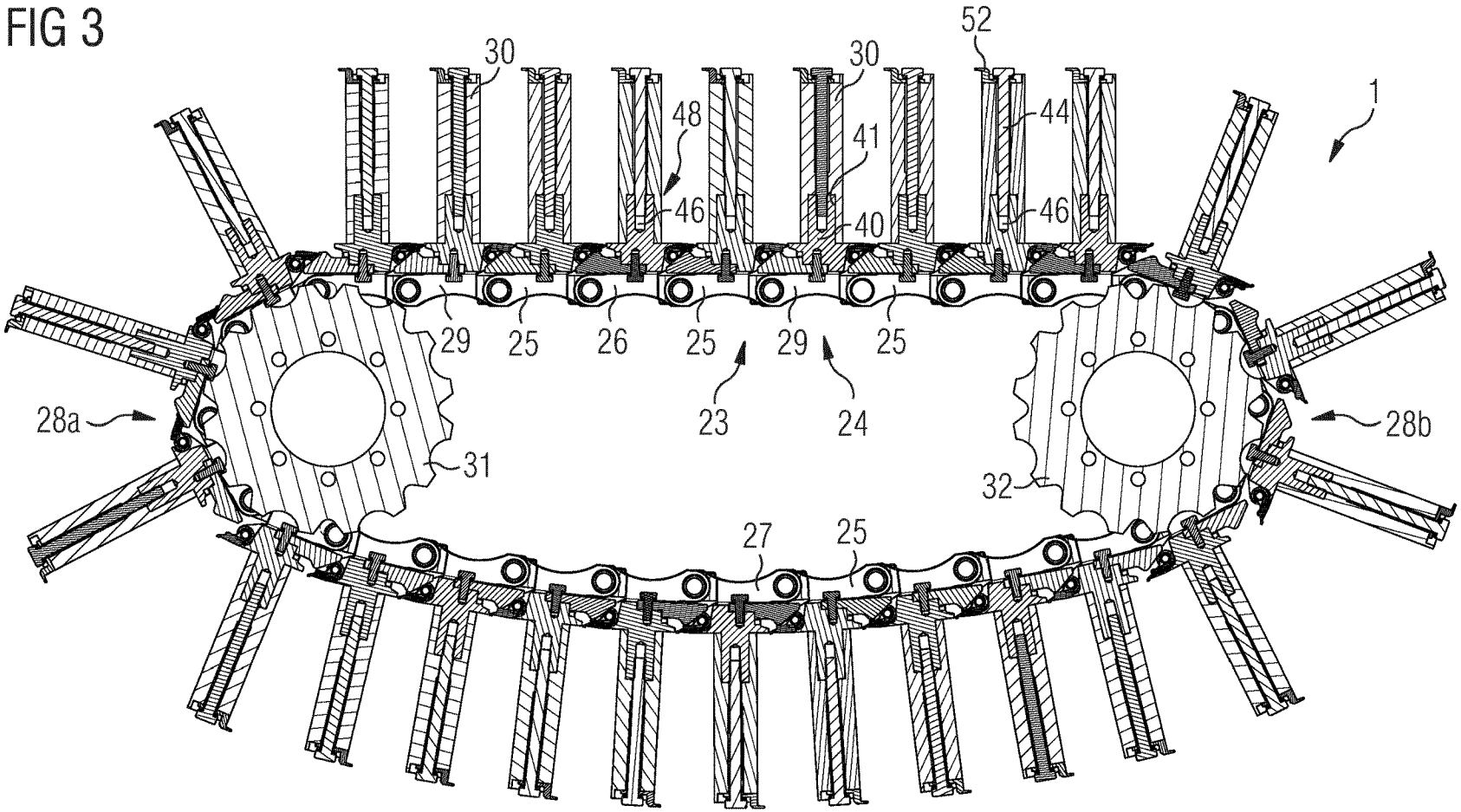
FIG. 3 is a longitudinal section, with parts removed for clarity, of the folding unit of FIG. 1.
Figure 4:
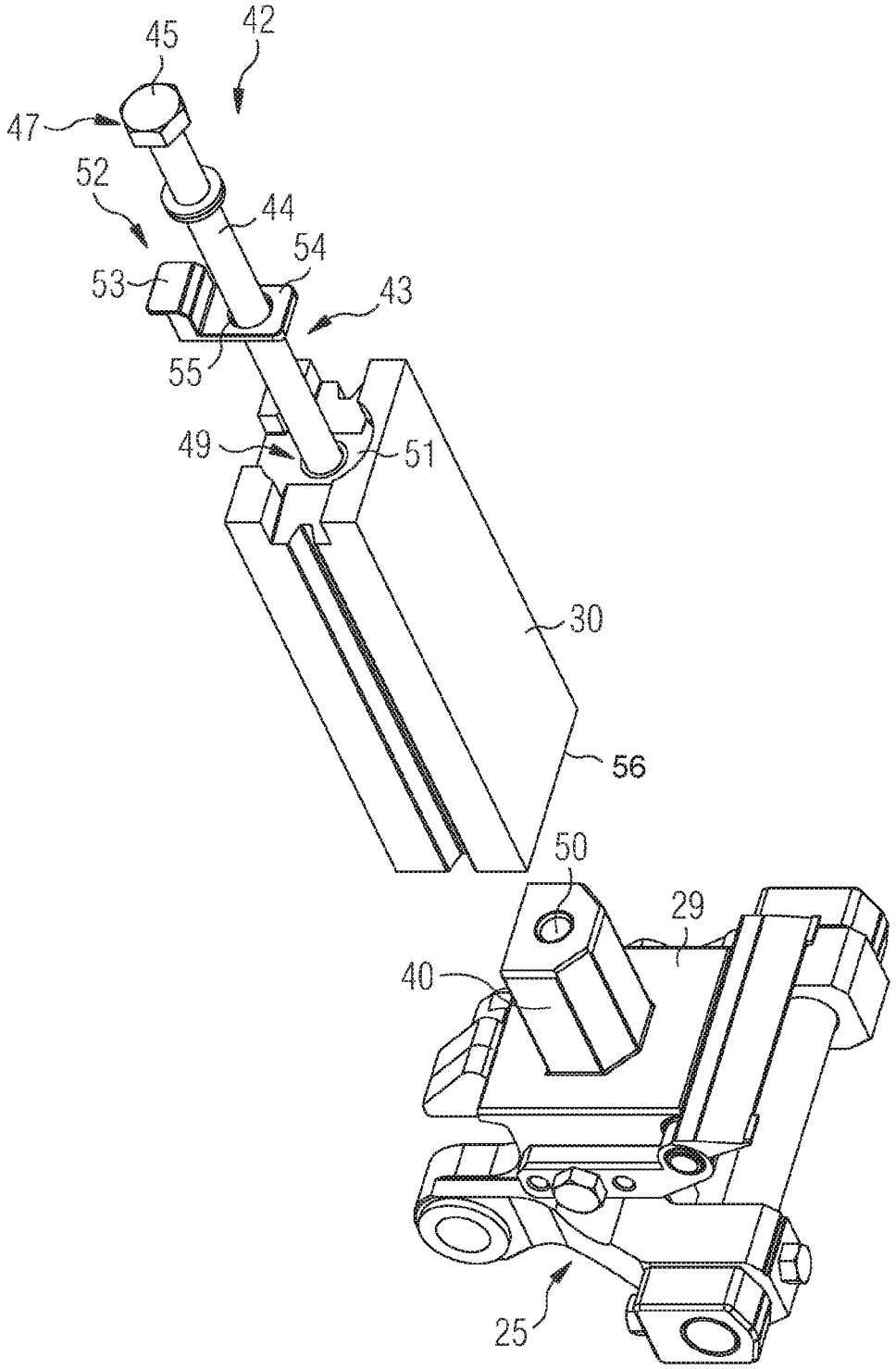
FIG. 4 is an exploded detail of the folding unit of FIG. 1.

With particular reference to FIGS. 3 and 4, each link 25 comprises a body 40 projecting from the plate 29 and so shaped as to be received into a seat 41 of the corresponding paddle 30.

The folding unit 1 further comprises releasable connecting elements 42 for releasably connecting each paddle 30 to the receptive link 25.

The releasable connecting elements 42 may assume a locking configuration, in which they firmly connect the paddle 30 to the link 25, and a releasing configuration, in which they allow the removal of the paddle 30 from the link 30.

Each releasable connecting element 42 may comprise a screw 43 having an elongated body 44, a head 45 and a threaded portion 46. The head is located at a first end 47 of the elongated body 44 and the threaded portion 46 is located at a second end 48 of the elongated body 44, opposite the first end 47.

Each paddle 30 comprises a bore 49 intended to receive the elongated body 44 of the screw 43.

The bore 49 extends parallel to a main longitudinal dimension of the paddle 30.

The body 44 comprises a threaded hole 50 intended to receive the threaded portion 48. The paddle 30 also comprises a retaining element 52 intended to retain the package 2 and to prevent the package 2 from sliding on the paddle 30 at the output station 14, so causing a mispositioning of the package 2 with respect to the paddle 30. If the package 2 is not arranged in the right position with respect to the paddle 30 at the output station 14, the removal of the package 2 from the folding unit 1 may be difficult, or even impossible.

The retaining element 52 comprises a supporting structure 53 connectable to the paddle 30 and an appendix 54 projecting from the paddle 30 and arranged for interacting with the package 2.

The supporting 53 structure has a through aperture 55 through which the elongated body 44 of the screw 43 passes, so that the screw 43 connects the retaining element 52 to the paddle 30.

In a working configuration of the folding unit 1, the body 40 of the link 25 is received in the seat 41 of the paddle 30. The elongated body 40 is received in the bore 49, the threaded portion 46 is screwed into the threaded hole 50 and the head 45 abuts on an end surface 51 of the paddle 30. A further end surface 56 of the paddle 30, opposite to the end surface 51 abuts on the plate 29 and the paddle 30 is firmly connected to the body 40, i.e. to the link 25.

When the folding unit 1 is in the working configuration the releasable connecting elements 42 are kept in the above-mentioned locking configuration.

In a setting configuration of the folding element 1, the threaded portion 46 is unscrewed from the threaded hole 50 and the screw 43 is removed from the bore 49. The body 40 of the link 25 is removed from the seat 41 of the paddle 30. The paddle 30, therefore, can be detached from the plate 39, i.e. from the link 25.

Figure 5:
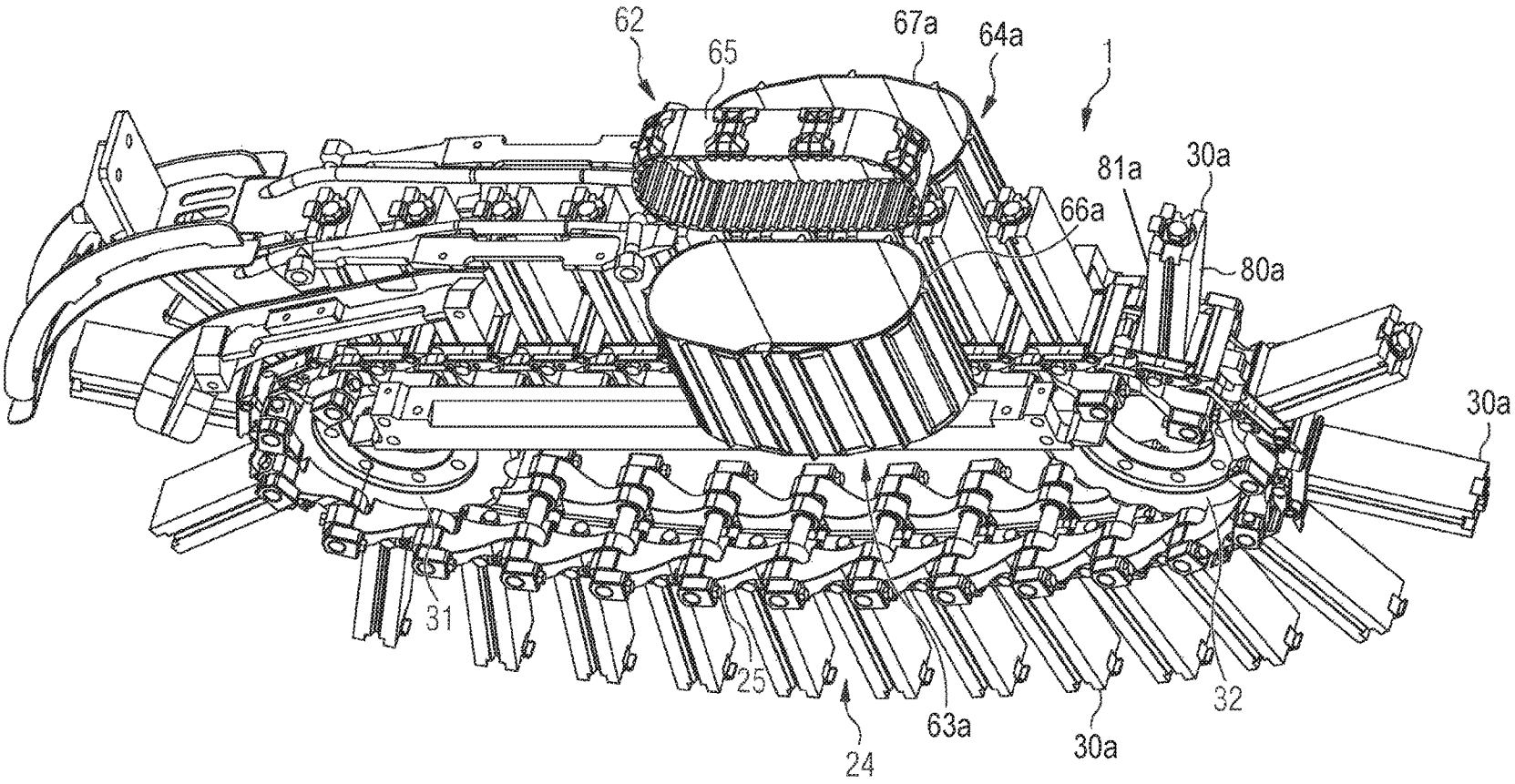
FIG. 5 is a perspective view, with parts removed for clarity, of the folding unit of FIG. 1 with a second plurality of paddles and further lateral pressing arrangements arranged thereon.

Subsequently, and as shown in FIG. 5, the paddle 30 can be replaced with a further paddle 30*a* having a further first surface 80*a* and a further second surface 81*a*.

When the folding unit 1 is in the working configuration the releasable connecting elements 42 are moved from the above-mentioned locking configuration to the above-mentioned realizing configuration, to allow replacement of the paddles 30 with the further paddles 30*a*, and then moved back from the above-mentioned releasing configuration to the above-mentioned locking configuration, to firmly connect the further paddles 30*a* to the links 25.

In one embodiment the further first surface 80*a* differs from the first surface 80.

In another embodiment the further second surface 81*a* differs from the second surface 81.

In another embodiment, both the further first surface 80*a* and the further second surface 81*a* differ from the first surface 80 and the second surface 81, respectively.

In other words, at least one of the further first surface 80*a* and further second surface 81*a* differs from the corresponding first surface 80 and second surface 81.

In this way, the paddles 30 are capable of forming a first type of package and the further paddles 30*a* are capable of forming a second type of packages.

The packages of the first type of packages may have substantially the same volume as the packages of the second type of packages, but a shape different from the shape of the packages of the second type of packages. As an example, the packages of the first type of packages may have a parallelepiped shape—as shown in FIG. 7—and the packages of the second type of packages may have non-rectangular side walls, for example side walls having curved, or polygonal, panels defining so-called design elements.

In the setting configuration of the folding unit 1, the first lateral pressing arrangement 63 and the second lateral pressing arrangement 64 are replaced with a further first lateral pressing arrangement 63*a* and with a further second lateral pressing arrangement 64*a*, respectively.

As illustrated in FIG. 5, the further first lateral pressing arrangement 63*a* comprises a further first belt 66*a* and the further second lateral pressing arrangement 64*a* comprises a further second belt 67*a*.

The further first belt 66*a* and the further second belt 67*a* have a further plurality of bulges extending from an outer surface of the further first belt 66*a* and the further second belt 67*a* and arranged for forming the second lateral walls 10*b*.

The conformation of the bulges of the further first belt 66*a* and the further second belt 67*a* differs from conformation of the bulges 71 of the first belt 66 and the second belt 67.

The conformation of the bulges 71 of the first belt 66 and the second belt 67 is designed so as to form the above-mentioned first type of packages, while the conformation of the bulges of the further first belt 66*a* and the further second belt 67*a* is designed so as to form the above-mentioned second type of packages.

During operation, the packs 3 are advanced by the endless conveyor 23. In particular, each pack 3 is received in the space defined by two consecutive paddles 30.

Upstream of the pressing device 22 the packs 3—whilst being moved by the endless conveyor 23 along the forming path B—interact with the first folding arrangement 15 that flattens the first end portion 8 and the second end portion 9 and folds the first end fin 17 onto the first end portion 8 and the second end fin 18 onto the second end portion 9.

The packs 3 also interact with the second folding arrangement that starts folding the first triangular flaps 19 onto the previously flattened first end portion 8 on the opposite side of the second end portion 9.

The packs 3 also interact with the third folding arrangement that starts folding the second triangular flaps 20 onto the corresponding second lateral walls 10*b* and towards the first end portion 8.

The packs 3 further interact with the heating device which acts on the partially bent first triangular flaps 19 and on the partially bent second triangular flaps 20 to melt the external plastic layer of the packaging material of the first triangular flaps 19 and the second triangular flaps 20 before they are pressed and sealed against the first end portion 8 and the second lateral walls 10*b*, respectively.

Subsequently, the packs 3 reach the pressing device 22.

The belt 65 of the top pressing arrangement 62 presses the first triangular flaps 19 onto the first end fin 17 and the first end portion 8.

The first belt 66 of the first lateral pressing arrangement 63 and the second belt 67 of the second lateral pressing arrangement 64 press the second triangular flaps 20 onto the second lateral walls 10*b*.

In this way, the final packages 2 are obtained from the packs 3.

Owing to the fact that the paddles are removably connectable to the links it is possible to pass from the production of packages of a first type to the production of packages of a second type, without the need to replace the complete folding unit.

In particular, the operation of replacing the paddles—and the first lateral pressing arrangement and the second lateral pressing arrangement—is rather quick and, therefore, does not adversely affects the productivity of the packaging machine, whilst—at the same time—provides to the packaging machine high flexibility.

The folding unit according to the invention allows, in particular, to switch from the production of a first type of packages to the production of a second type of packages, the packages of the second type of packages having substantially the same volume as the packages of the first type of packages, but a shape different from the shape of the packages of the second type of packages. As an example, the packages of the first type of packages may have a parallelepiped shape and the packages of the second type of packages may have non-rectangular side walls, for example side walls having curved, or polygonal.

Clearly, changes may be made to unit 1 without, however, departing from the protective scope defined in the accompanying claims.

The invention claimed is:

1. A folding unit for producing packages from sealed packs, the folding unit comprising:

an endless chain conveyor carrying a first plurality of paddles configured to move the packs along an advancement direction and to fold the packs into the produced packages, each paddle of the first plurality of paddles having a first surface configured to interact with a first pack to form a portion of a corresponding first package and a second surface configured to interact with a second pack to form a portion of a corresponding second package, wherein the chain conveyor further includes:

a plurality of connected links, each link carrying a corresponding paddle of the first plurality of paddles, wherein each paddle of the first plurality of paddles comprises a seat, and wherein each link comprises:

a plate; and a body projecting from the plate and configured to be received in the seat;

a releasable connecting element corresponding to each paddle of the first plurality of paddles and configured to releasably connect the corresponding paddle of the first plurality of paddles to the corresponding link of the chain conveyor, wherein each releasable connecting element comprises:

a screw having an elongated body, a head, and a threaded portion; and a second plurality of paddles for replacing the first plurality of paddles, each of the second paddles having:

a further first surface, and a further second surface, wherein each paddle of the first plurality of paddles comprises a first end surface that abuts the plate of the corresponding link when the paddle is connected to the body of the corresponding link by the corresponding releasable connecting element, wherein the head of each releasable connecting element abuts a second end surface of the corresponding paddle of the first plurality of paddles, the second end surface of the corresponding paddle of the first plurality of paddles being opposite to the first end surface of the corresponding paddle of the first plurality of paddles, and wherein at least one of the further first surface and further second surface of the second plurality of paddles is different from the corresponding first surface and second surface of the first plurality of paddles, such that the first plurality of paddles is configured to produce a first type of packages having a first package shape and the second plurality of paddles is configured to produce a second type of packages having a second package shape, wherein the first package shape is different than the second package shape.

2. A folding unit according to claim 1, wherein the elongated body is received in a bore of the corresponding paddle of the first plurality of paddles and the threaded portion is screwed into a threaded hole of the body.

3. A folding unit according to claim 2, wherein the bore extends parallel to a main longitudinal dimension of the paddle.

4. A folding unit according to claim 1, wherein the head is located at a first end of the elongated body and the threaded portion is located at a second end of the elongated body, opposite the first end of the elongated body.

5. A folding unit according to claim 1, wherein the plate is configured to receive the pack.

6. A folding unit according to claim 1, further comprising:

a first lateral pressing arrangement; and a second lateral pressing arrangement configured to press flaps of the first pack onto lateral walls of the first pack, the first lateral pressing arrangement and the second lateral pressing arrangement located on opposite sides of the chain conveyor, wherein the first lateral pressing arrangement comprises a first belt and the second lateral pressing arrangement comprises a second belt, the first belt and the second belt having a plurality of bulges extending from an outer surface of the first belt and the second belt, respectively, and configured to form the lateral walls of the first pack.

7. A folding unit according to claim 6, further comprising:

a further first lateral pressing arrangement for replacing the first lateral pressing arrangement; and a further second lateral pressing arrangement for replacing the second lateral pressing arrangement, wherein the further first lateral pressing arrangement comprises a further first belt and the further second lateral pressing arrangement comprises a further second belt, the further first belt and the further second belt having a further plurality of bulges extending from an outer surface of the further first belt and the further second belt, respectively, and arranged for forming the lateral walls of the first pack, and wherein a shape of the bulges of the further first belt and the further second belt are different from the bulges of the first belt and the second belt.

8. A folding unit according to claim 7, wherein the shape of the bulges of the first belt and the second belt is configured to form the first type of packages and the shape of the bulges of the further first belt and the further second belt is configured to form the second type of packages.

9. A folding unit for producing packages from sealed packs, the folding unit comprising:

an endless chain conveyor carrying a plurality of paddles configured to move the packs along an advancement direction and to fold the packs into the produced packages, each paddle having a first surface configured to interact with a first pack to form a portion of a corresponding first package and a second surface configured to interact with a second pack to form a portion of a corresponding second package, wherein the chain conveyor further includes:

a plurality of connected links, each link carrying a corresponding paddle of the plurality of paddles, wherein each paddle comprises a seat, and wherein each link comprises:

a plate, and a body projecting from the plate and configured to be received in the seat;

a releasable connecting element corresponding to each paddle and configured to releasably connect the corresponding paddle to the corresponding link of the chain conveyor, wherein each releasable connecting element comprises:

a screw having an elongated body, a head, and a threaded portion, wherein each paddle comprises a first end surface that abuts the plate of the corresponding link when the paddle is connected to the body of the corresponding link by the corresponding releasable connecting element, and wherein the head of each releasable connecting element abuts a second end surface of the corresponding paddle, the second end surface of the corresponding paddle being opposite to the first end surface of the corresponding paddle;

a first lateral pressing arrangement; and a second lateral pressing arrangement configured to press flaps of the first pack onto lateral walls of the first pack, the first lateral pressing arrangement and the second lateral pressing arrangement located on opposite sides of the chain conveyor, wherein the first lateral pressing arrangement comprises a first belt and the second lateral pressing arrangement comprises a second belt, the first belt and the second belt having a plurality of bulges extending from an outer surface of the first belt and the second belt, respectively, and configured to form the lateral walls of the first pack.

10. A folding unit according to claim 9, wherein the elongated body is received in a bore of the corresponding paddle and the threaded portion is screwed into a threaded hole of the body.

11. A folding unit according to claim 10, wherein the bore extends parallel to a main longitudinal dimension of the paddle.

12. A folding unit according to claim 9, wherein the head is located at a first end of the elongated body and the threaded portion is located at a second end of the elongated body, opposite the first end of the elongated body.

13. A folding unit according to claim 9, wherein the plate is configured to receive the pack.

14. A folding unit according to claim 9, wherein the plurality of paddles of the chain conveyor are a first plurality of paddles, the folding unit further comprising:

a second plurality of paddles for replacing the first plurality of paddles, each of the second paddles having:

a further first surface, and a further second surface, wherein at least one of the further first surface and further second surface of the second plurality of paddles is different from the corresponding first surface and second surface of the first plurality of paddles, such that the first plurality of paddles is configured to produce a first type of packages having a first package shape and the second plurality of paddles is configured to produce a second type of packages having a second package shape, wherein the first package shape is different than the second package shape.

15. A folding unit according to claim 9, further comprising:

a further first lateral pressing arrangement for replacing the first lateral pressing arrangement; and a further second lateral pressing arrangement for replacing the second lateral pressing arrangement, wherein the further first lateral pressing arrangement comprises a further first belt and the further second lateral pressing arrangement comprises a further second belt, the further first belt and the further second belt having a further plurality of bulges extending from an outer surface of the further first belt and the further second belt, respectively, and arranged for forming the lateral walls of the first pack, and wherein a shape of the bulges of the further first belt and the further second belt are different from the bulges of the first belt and the second belt.

16. A folding unit according to claim 15, wherein the shape of the bulges of the first belt and the second belt is configured to form a first type of packages having a first package shape and the shape of the bulges of the further first belt and the further second belt is configured to form a second type of packages having a second package shape, wherein the first package shape is different than the second package shape.

* * * * *